US006660949B2

(12) United States Patent
Kamino et al.

(10) Patent No.: US 6,660,949 B2
(45) Date of Patent: Dec. 9, 2003

(54) SAFETY SWITCH ACTUATOR

(75) Inventors: Yasushi Kamino, Osaka (JP); Takao Fukui, Osaka (JP); Yoshio Sekino, Osaka (JP); Kenji Miyauchi, Osaka (JP); Hideo Niinai, Osaka (JP); Tokunori Tanaka, Osaka (JP); Kazuya Okada, Osaka (JP); Ken Maeda, Osaka (JP); Yoshihiro Shima, Osaka (JP)

(73) Assignee: Idec Izumi Corporation, Osaka (JP)

( * ) Notice: Subject to any disclaimer, the term of this patent is extended or adjusted under 35 U.S.C. 154(b) by 105 days.

(21) Appl. No.: 09/926,074

(22) PCT Filed: Dec. 25, 2000

(86) PCT No.: PCT/JP00/09218

§ 371 (c)(1),
(2), (4) Date: Aug. 24, 2001

(87) PCT Pub. No.: WO01/48773

PCT Pub. Date: Jul. 5, 2001

(65) Prior Publication Data

US 2002/0157930 A1 Oct. 31, 2002

(30) Foreign Application Priority Data

Dec. 28, 1999 (JP) ..... 11/373154

(51) Int. Cl.[7] ..... H01H 27/00

(52) U.S. Cl. ..... 200/43.07; 200/17 R; 200/47; 200/61.59; 200/334

(58) Field of Search ..... 200/43.07, 43.02, 200/43.03, 43.04, 43.08, 43.11, 17 R, 47, 61.59, 61.63, 61.66, 334

(56) References Cited

U.S. PATENT DOCUMENTS

| | | | | | |
|---|---|---|---|---|---|
| 4,524,251 | A | * | 6/1985 | Schulz | 200/42 R |
| 4,904,829 | A | * | 2/1990 | Berthaud et al. | 200/50 R |
| 4,963,706 | A | * | 10/1990 | Mohtasham | 200/334 |
| 5,662,212 | A | * | 9/1997 | Wecke et al. | 200/43.04 |
| 5,744,767 | A | * | 4/1998 | Wecke et al. | 200/17 R |

FOREIGN PATENT DOCUMENTS

| | | |
|---|---|---|
| JP | 6-76674 | 3/1994 |
| JP | 8-285183 | 11/1996 |
| JP | 10-69831 | 3/1998 |
| JP | 11-213820 | 8/1999 |

* cited by examiner

*Primary Examiner*—Lincoln Donovan
*Assistant Examiner*—K. Lee
(74) *Attorney, Agent, or Firm*—Armstrong, Kratz, Quintos, Hanson & Brooks, LLP

(57) ABSTRACT

An actuator of the present invention comprises an operation key 2 to be inserted into a key insertion hole formed in the safety switch, and a base 3. The operation key 2 is held on the base 3 and capable of freely swinging in two orthogonal directions. The actuator also comprises means (e.g. a guide stopper 4 and engagement spaces 34) for selectively restricting the swinging movement of the operation key 2 to either of the two directions.

5 Claims, 23 Drawing Sheets

(A)

(B)

(A)

(B)

SAFETY SWITCH ACTUATOR

TECHNICAL FIELD

The present invention relates to a safety switch which is mounted on a wall surface of the doorway of a room for installing an industrial machine or the like, and which discontinues power supply to the industrial machine or the like when the door at the doorway is opened.

BACKGROUND ART

In a room or factory which accommodates an industrial machine, or in a danger zone around an industrial machine itself, it is required to install a system for locking the drive of the machine. The locking system operates when the door at the doorway for the room or danger zone is not closed completely, in order to prevent accidents in which an operator may get caught in the machine and injured.

With regard to a common locking system, a limit switch is disposed at the slidable portion of the door. The system provides power to the industrial machine inside the room, only when the limit switch detects the closure of the door.

Nevertheless, this locking system is not a perfect safety measure, because the machine inside the room can be turned operable, without closing the door, by manipulating the actuator of the limit switch.

In this respect, the applicant of the present invention has already proposed a safety switch for preventing such wrong operations (Japanese Patent Laid-open Publication No. H6-76674 (JP-A-6-76674).

The proposed safety switch has an operation section and a switch section, and comprises a switch body which includes a key insertion hole formed in the casing of the operation section (see FIG. 1) and an actuator composed of a base and an operation key provided therewith. The switch body is mounted on the wall surface around the doorway of the room, whereas the actuator is secured on the door (sliding or revolving door) at the doorway. On closure of the door, the operation key of the actuator enters the operation section through the key insertion hole in the switch body, causing the contact block housed in the switch section to switch over its moving contact. This switch-over action directs the circuit connection to the main circuit (power supply circuit for the industrial machine) and sets the machine in the room ready for operation.

In another use, the safety switch is disposed at a connection point with a mobile device which is connected to a teaching device or similar device body. When the mobile device is properly connected to the device body, the operation key of the actuator enters the switch body of the safety switch to set the device body to an operable state.

When the actuator for these safety switches is mounted on the door, the operation key is oriented horizontally or vertically, depending on the conditions of use (e.g. installation posture of the switch body).

However, in many of the conventional actuators, the operation key is fixedly held on the base with no freedom in movement. As illustrated in FIG. 29, if the actuator is used for a revolving door 10 with a small radius of revolution, the tip of an operation key 502 may interfere with a switch body 100 when the revolving door 10 closes. Because of this problem, a fixed actuator is not applicable to the revolving door 10 having a small revolution radius.

In order to solve this problem, another actuator (an operation key device for a safety switch) is disclosed in Japanese Patent Laid-open Publication No. H11-213820 (JP-A-11-213820), wherein the operation key is mounted on the base in such a manner as to be capable of swinging in orthogonal directions (horizontal and vertical directions). According to this actuator, however, the operation key is constantly swingable in two directions (horizontal and vertical directions), and held in a tilted posture both horizontally and vertically. Under these conditions, it is difficult to position this actuator relative to the switch body.

Made in view of such circumstances, the present invention intends to provide an actuator in which the operation key can move relative to the base, whereby the actuator becomes applicable to a revolving door with a small revolution radius and the like, and in which the movable direction of the operation key can be selectively changed over into either of the horizontal direction or the vertical direction.

DISCLOSURE OF THE INVENTION

In order to achieve the above object, the actuator of the present invention comprises an operation key to be inserted into a key insertion hole formed in the safety switch, and a base, characterized in that the operation key is held on the base and capable of freely swinging in two orthogonal directions, and also characterized in comprising means for selectively restricting the swinging movement of the operation key to either of the two directions.

The actuator of the present invention gives the operation key a freedom of being swingable in two directions (horizontal and vertical directions). Even if the operation key may interfere with the switch body on entry into the key insertion hole in the switch body, the operation key can swing to avoid such interference. Therefore, this actuator can be used, for example, for a revolving door with a small radius of revolution. Besides, the swinging direction of the operation key can be selectively changed over into either the horizontal direction or the vertical direction, so that the operation key is allowed to swing only in a direction in which the freedom is required. As a result, the safety switch can be installed without any difficulty in positioning the actuator relative to the switch body.

The actuator of the present invention may be provided with two engagement spaces which are formed in the base and a guide stopper which is configured to fit into each of the engagement spaces. By fitting the guide stopper selectively into either of the two engagement spaces, it is possible to restrict the swinging direction of the operation key to one direction.

The actuator of the present invention may comprise an adjustment mechanism for independently adjusting a swinging range of the operation key in each swinging direction. Thereby, the swinging range of the operation key can be easily set to a suitable range, depending on the conditions of use (e.g. revolution radius of a revolving door).

If the actuator of the present invention comprises an elastic member for biasing the operation key in each swinging direction, the operation key can be held at a certain position under an elastic force. In this case, the operation key may be biased in each swinging direction by a torsion force and a compression force both generated by a helical coil spring, so that the number of parts can be reduced (thus, the cost is reduced).

BEST MODE FOR CARRYING OUT THE INVENTION

Embodiments of the present invention are hereinafter described, based on the drawings.

Figure 1:
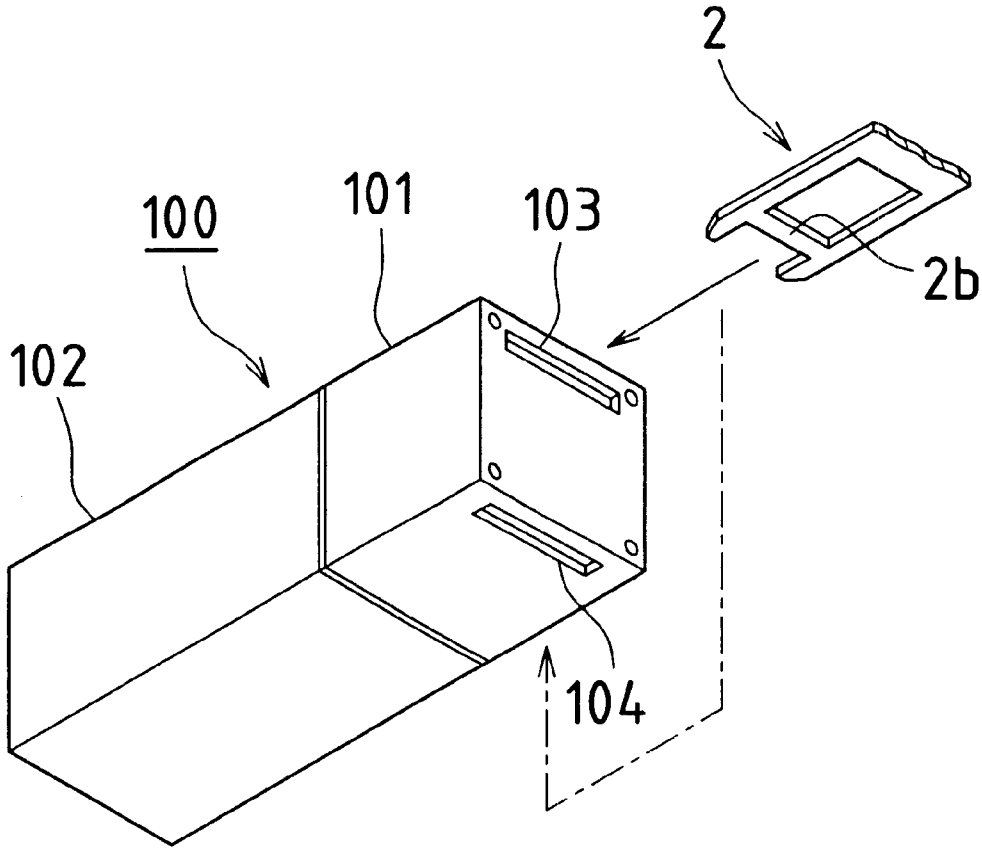
FIG. 1 is a perspective view schematically showing the structure of a safety switch.
Figure 2:
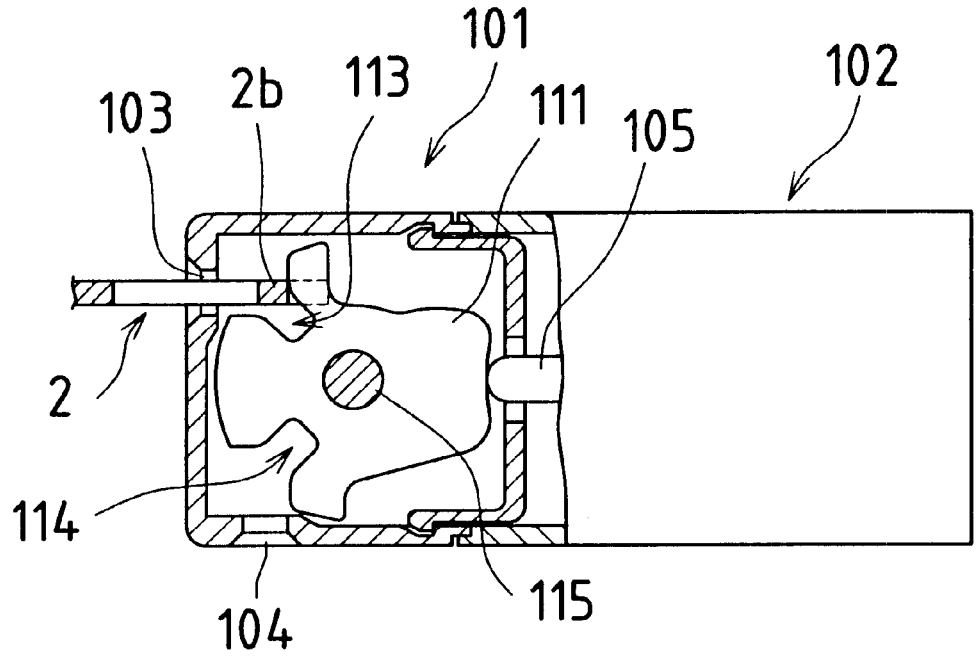
FIGS. 2(A) and 2(B) and 3(A) and 3(B) describe operations of the safety switch.
Figure 2:
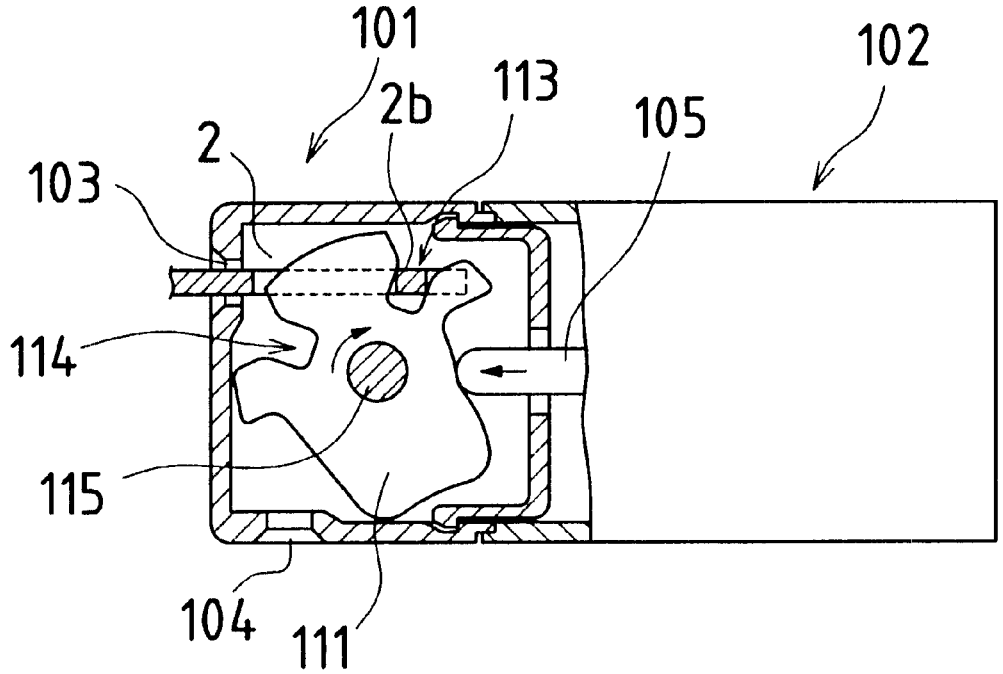
Figure 3:
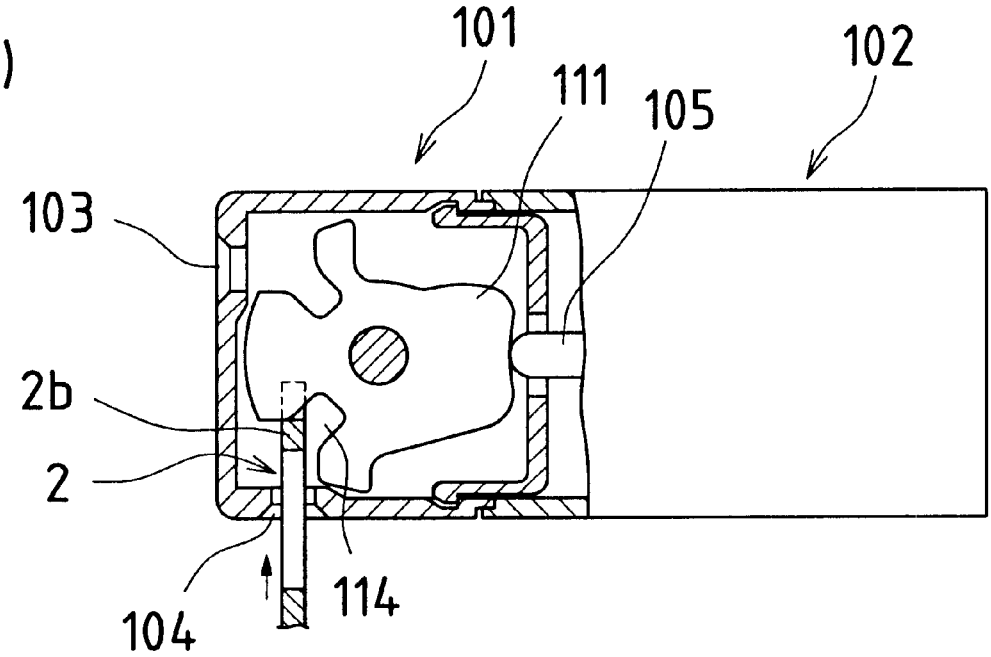
Figure 3:
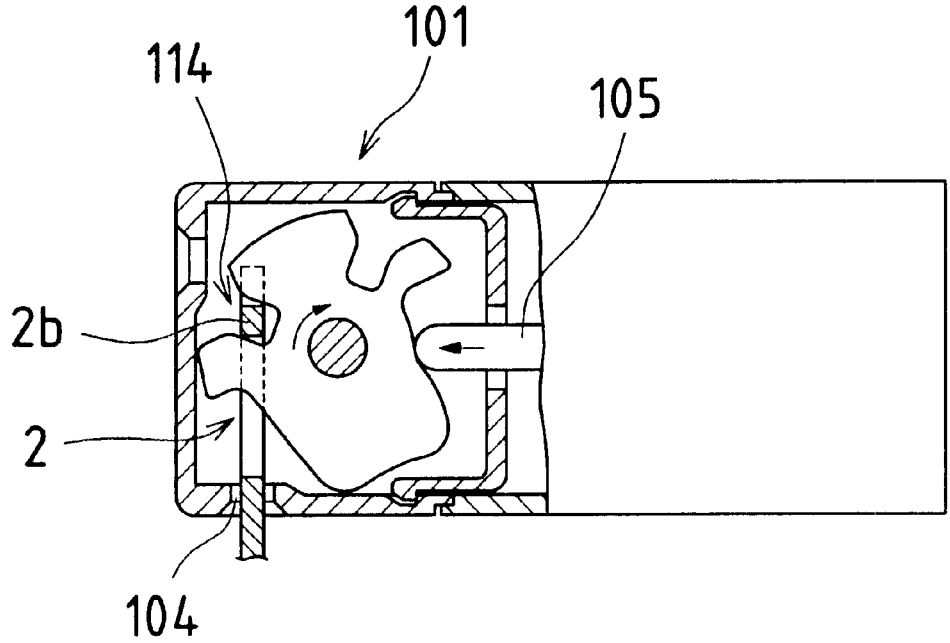

To begin with, the schematic structure of a safety switch is mentioned with reference to FIGS. 1 to 3.

Figure 4:
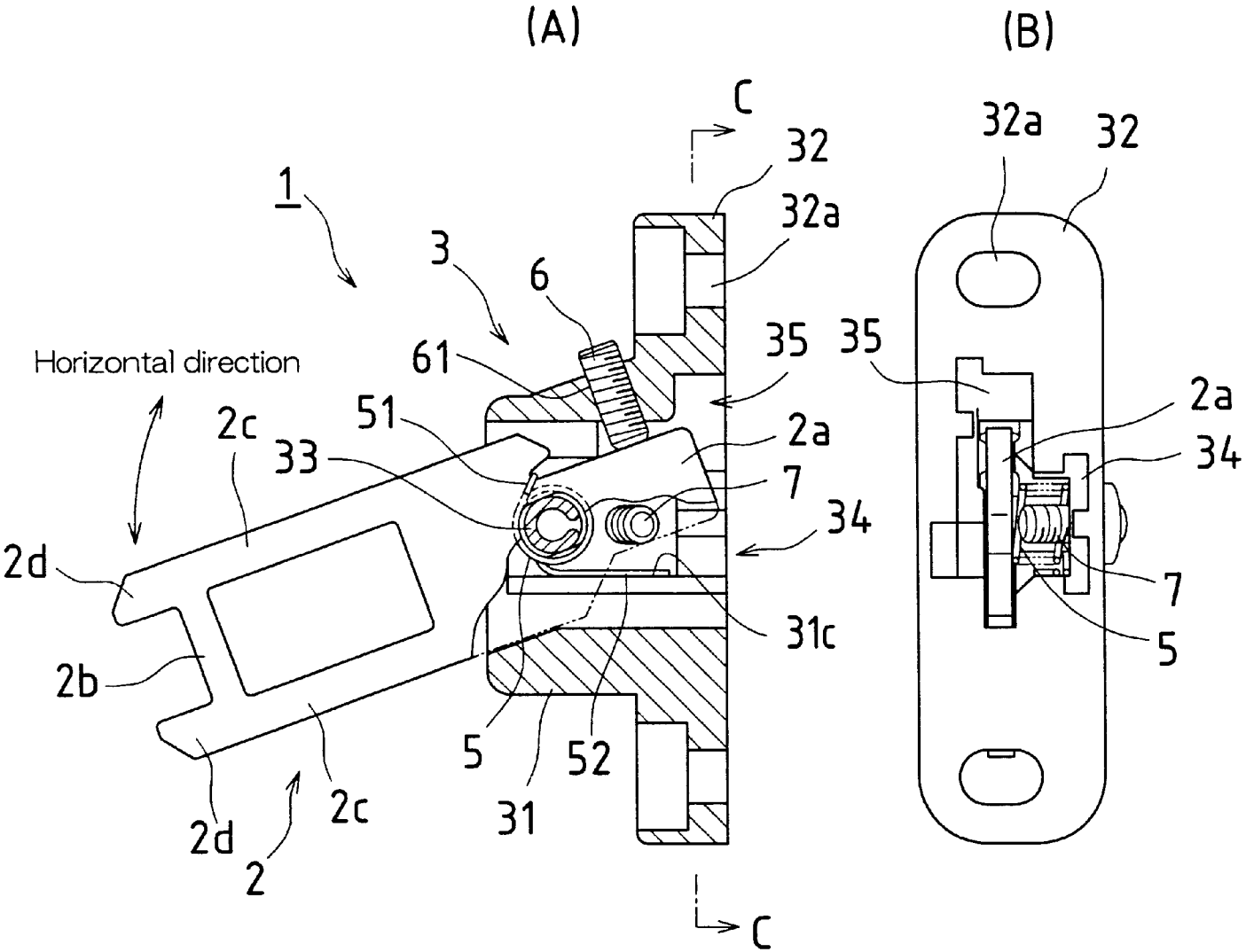
FIG. 4(A) is a vertical sectional view of an embodiment of the present invention.
FIG. 4(B) is a rear view thereof.
Figure 5:
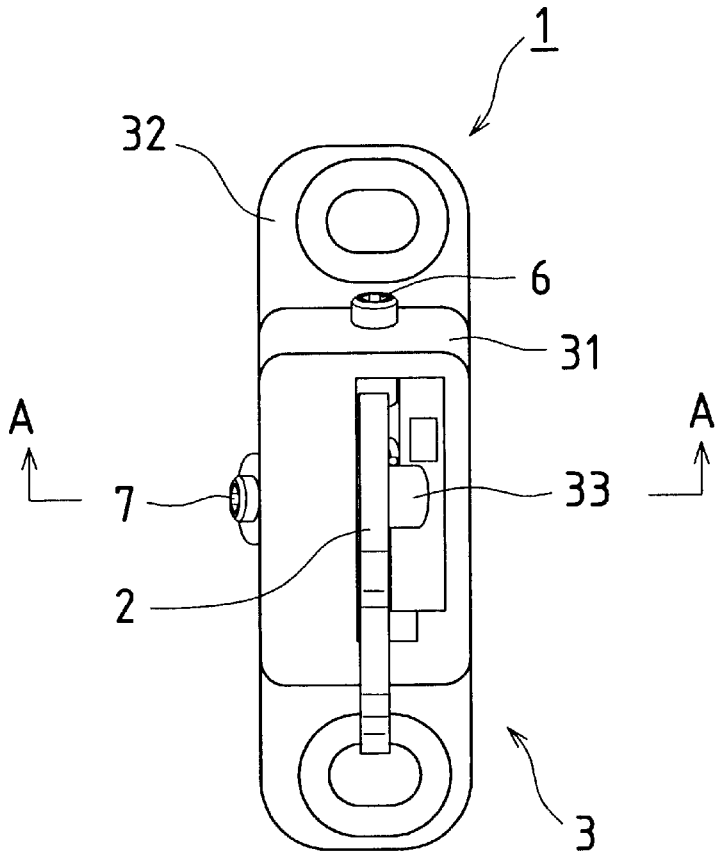
FIG. 5 is a front view thereof.

The safety switch of this example is electrically connected to an industrial machine which is installed in a room, and mainly composed of a switch body 100 and an actuator 1 (see FIG. 4). The switch body 100 is secured on the wall surface in the periphery of the doorway of the room. The actuator 1 is fixed on the revolving door.

The switch body 100 comprises an operation section 101 into which an operation key 2 of the actuator 1 is inserted, and a switch section 102 which contains a built-in contact block (not shown). The operation section 101 has two key insertion holes (slit holes) 103, 104 which enable selection of the insertion direction of the actuator 1.

The operation section 101 houses a plate cam 111 which is rotatably held by a cam shaft 115. The plate cam 111 causes displacement of an operation rod 105 of the contact block (not shown) which is housed in the switch section 102. The outer circumferential surface of the plate cam 111 has rectangular recesses 113, 114 which correspond to the two key insertion holes 103, 104 in the operation section 101.

With regard to the safety switch of this structure, FIG. 2 illustrates entry of the operation key 2 into the operation section 101, through the key insertion hole 103. At this moment, a push piece 2*b* of the operation key 2 comes into contact with the plate cam 111 (FIG. 2(A)). Further entry of the operation key 2 causes the plate cam 111 to rotate, and, in turn, the rotation of the plate cam 119 causes the operation rod 105 of the switch section 102 to move toward the operation section 101. When the operation key 2 advances as far as the insertion end, the connection contact of the contact block is switched over, and the push piece 2*b* of the operation key 2 fits into the recess 113 in the plate cam 111 (FIG. 2(B)). In the state shown in FIG. 2(B), where the operation key 2 is pulled out, the retreat of the operation key 2 causes the plate cam 111 to rotate in the reverse direction relative to the above direction. In this connection, the operation rod 105 moves toward the switch section 102 to switch over the contact connection back to the initial state.

Likewise, FIG. 3 describes entry of the operation key 2 into the operation section 101, through another key insertion hole 104 in the operation section 101. Referring to FIG. 3(A), the push piece 2*b* of the operation key 2 comes into contact with the plate cam 111, and further entry of the operation key 2 causes the plate cam 111 to rotate. In response to the rotation of the plate cam 111, the operation rod 105 of the switch section 102 moves toward the operation section 101 to switch over the connection contact, and the push piece 2*b* of the operation key 2 fits into the recess 114 in the plate cam 111 (FIG. 3(B)). In this state, when the operation key 2 is pulled out, the plate cam 111 rotates backwards, so that the operation rod 105 moves toward the switch section 102 to switch over the connection contact.

Figure 13:
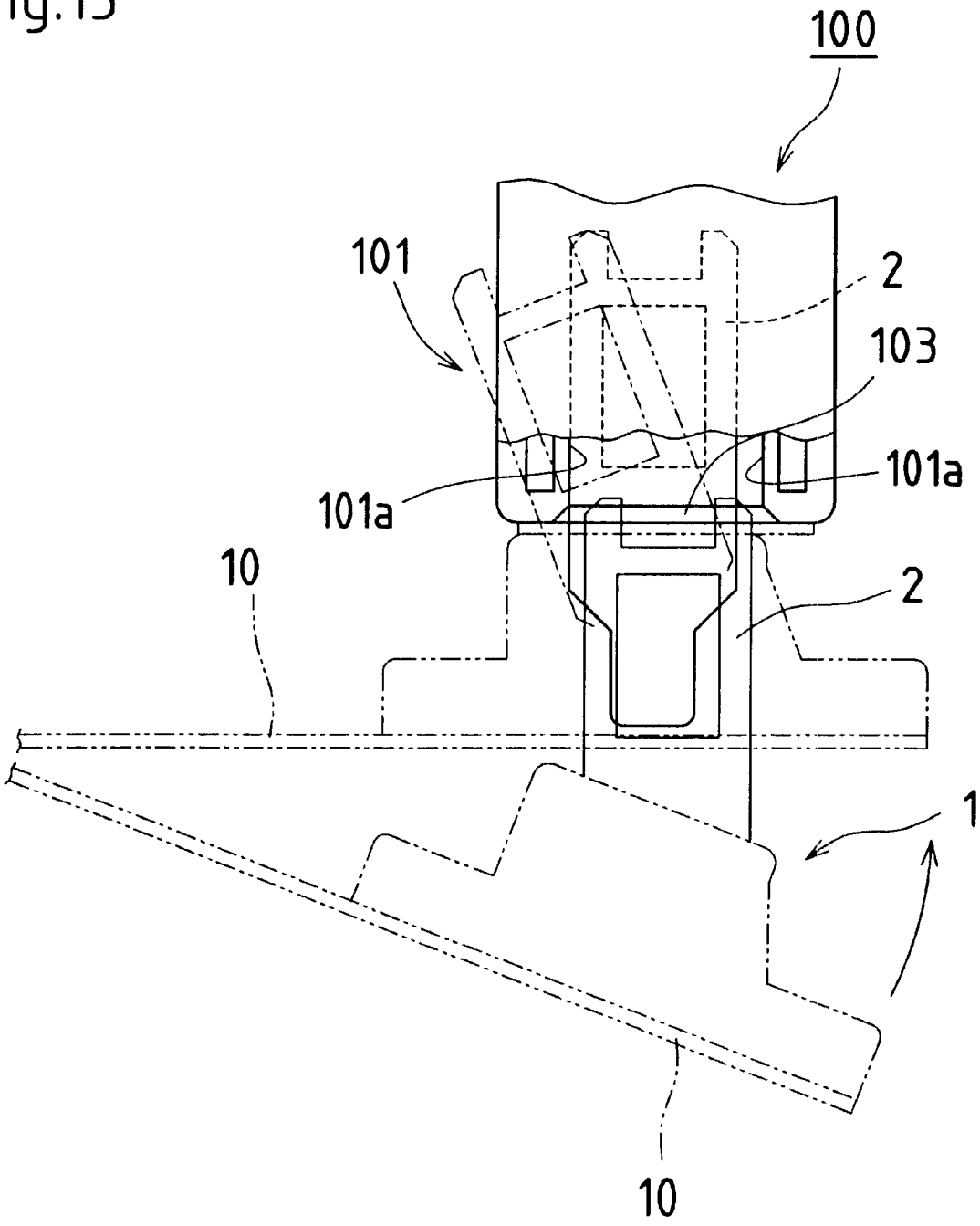
FIGS. 13 and 14 describe the actions in the embodiment of the present invention.
Figure 14:
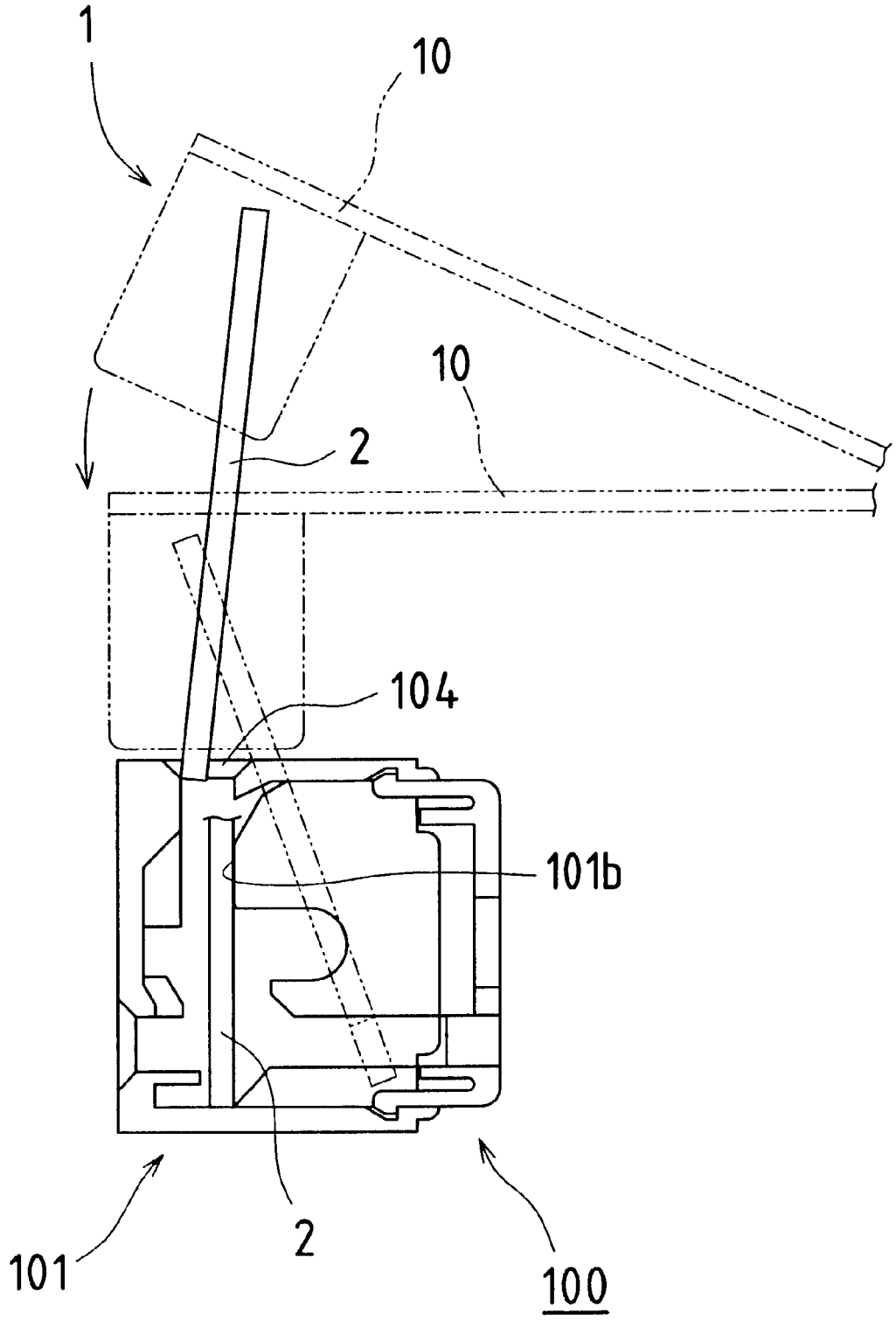

Incidentally, the operation section 101 is internally formed with guide surfaces 101*a*, 101*b* in order to guide the front end portion of the operation key 2 after it enters the key insertion hole 103, 104 (see FIGS. 13 and 14).

Turning now to FIGS. 4 to 12, the actuator 1 of this embodiment is described in detail.

The actuator 1 comprises an operation key 2 and a base 3. The operation key 2 is a metal component or the like. As can be seen in FIG. 4, the portion to be inserted into the operation section 101 is integrally composed of a push piece 2*b* at the front end portion and a pair of support pieces 2*c* for holding both ends thereof. The front end portion of the pair of support pieces 2*c* protrude ahead of the push piece 2*b*. The extremities of protrusions 2*d* are chamfered at about 45°. The operation key 2 is held on a support shaft 33 provided in the base 3, and capable of freely swinging in two directions that intersect at right angles (horizontal and vertical directions). Its rear end includes an integrally formed contact piece 2*a*.

The base 3 is made of a resin such as polyamide 6,6 (PA66), and integrally composed of a key holding part 31 and a mounting part 32. A mounting slot (elliptic slot) 32*a* is formed at each end of the mounting part 32.

Figure 6:
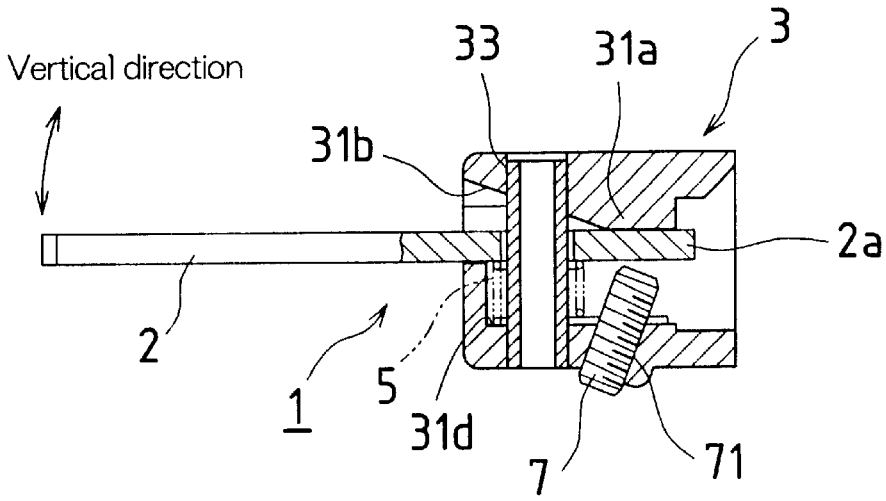
FIG. 6 is a sectional view of the embodiment shown in FIG. 5, taken along the line A—A.
Figure 7:
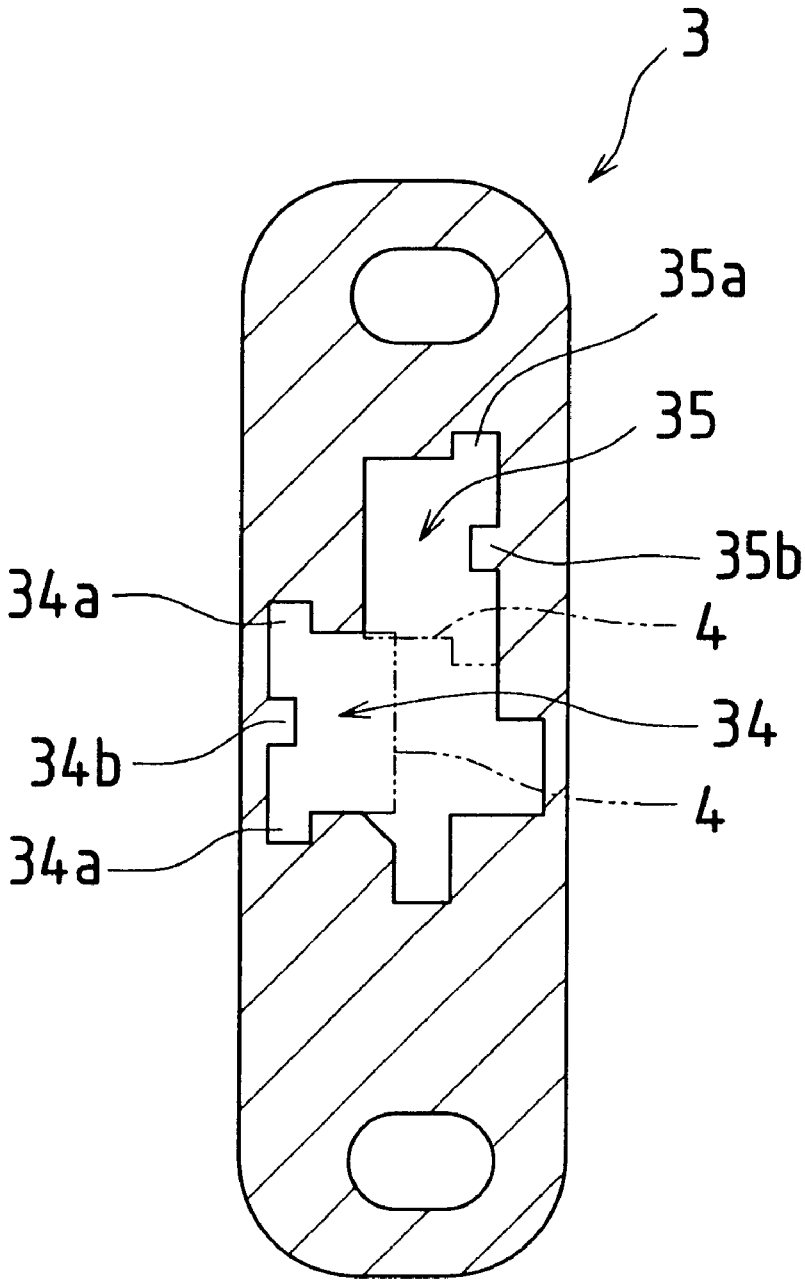
FIG. 7 is a sectional view taken along the line C—C in FIG. 4.

The key holding part 31 includes a hollow structure which penetrates from the front to the back of the base 3. The front part houses a support shaft 33. Inside the key holding part 31, as shown in FIG. 6, a support point 31*a* locates opposite to the contact piece 2*a* of the operation key 2 which is held on the support shaft 33. An inclined surface 31*b* is defined from the support point 31*a* to the front of the base 3, with the surface being tilted outwardly toward the front.

The support shaft 33 is wrapped by a helical torsion spring 5. One end 51 of the helical torsion spring 5 is checked at the operation key 2, whereas another end 52 is checked at an inner surface 31*c* of the key holding part 31 in such a manner that a torsion force is imposed on the helical torsion spring 5 itself. In addition, the helical torsion spring 5 is squeezed, in a compressed state, between the operation key 2 and an inner surface 31*d* of the key holding part 31 (the surface opposite to the inclined surface 31*b*). The torsion force and the compression force of the helical torsion spring 5 presses the operation key 2 in the horizontal and vertical directions, respectively.

At the side of the key holding part 31, two female threaded holes (through-holes) 61, 71 are machined. Adjustment screws (e.g. screws with a hexagonal bore) 6, 7 are respectively screwed in the female threaded holes 61, 71. By operating these adjustment screws 6, 7, it is possible to adjust the horizontal swinging range and the vertical swinging range of the operation key 2 independently.

Figure 8:
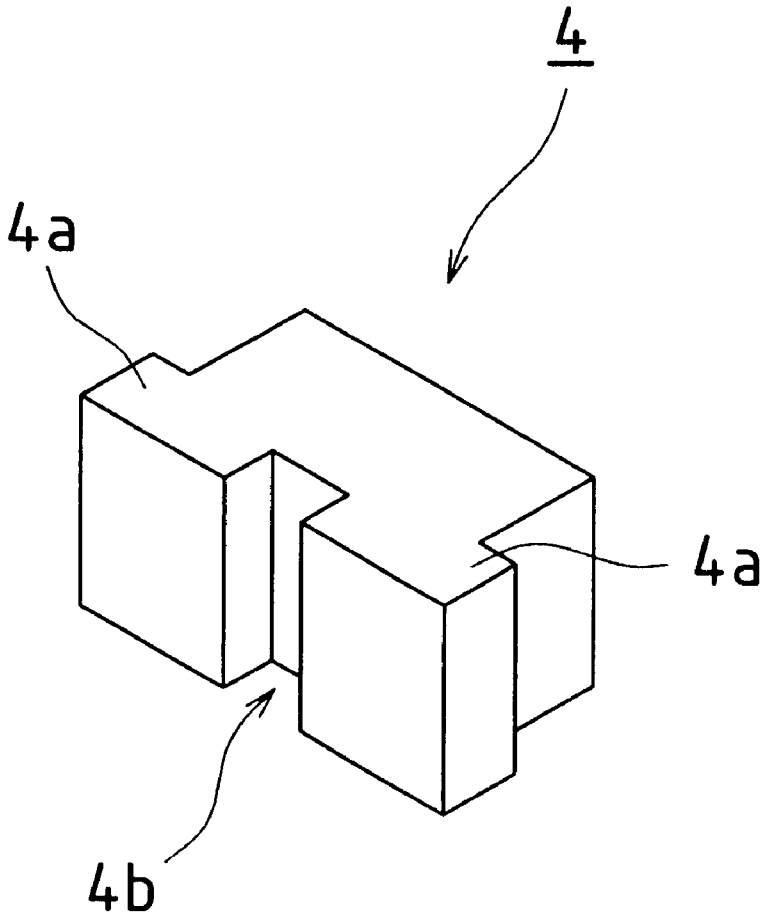
FIG. 8 is a perspective view of the guide stopper to be used in the embodiment of FIG. 4.

In the rear of the base 3, engagement spaces 34, 35 are provided beside a first major surface (the surface not facing the support point 31*a*) of the contact piece 2*a* of the operation key 2 and laterally of the contact piece 2*a*. These engagement spaces 34, 35 are defined by guide grooves 34*a*, 35*a* and guide projections 34*b*, 35*b* (see FIG. 7) which fit guide flanges 4*a* and a guide groove 4*b* of a guide stopper 4 whose configuration is illustrated in FIG. 8. When the guide stopper 4 is selectively fitted into either of these two engagement spaces 34, 35, the swinging direction of the operation key 2 is restricted to either the horizontal direction or the vertical direction.

Figure 9:
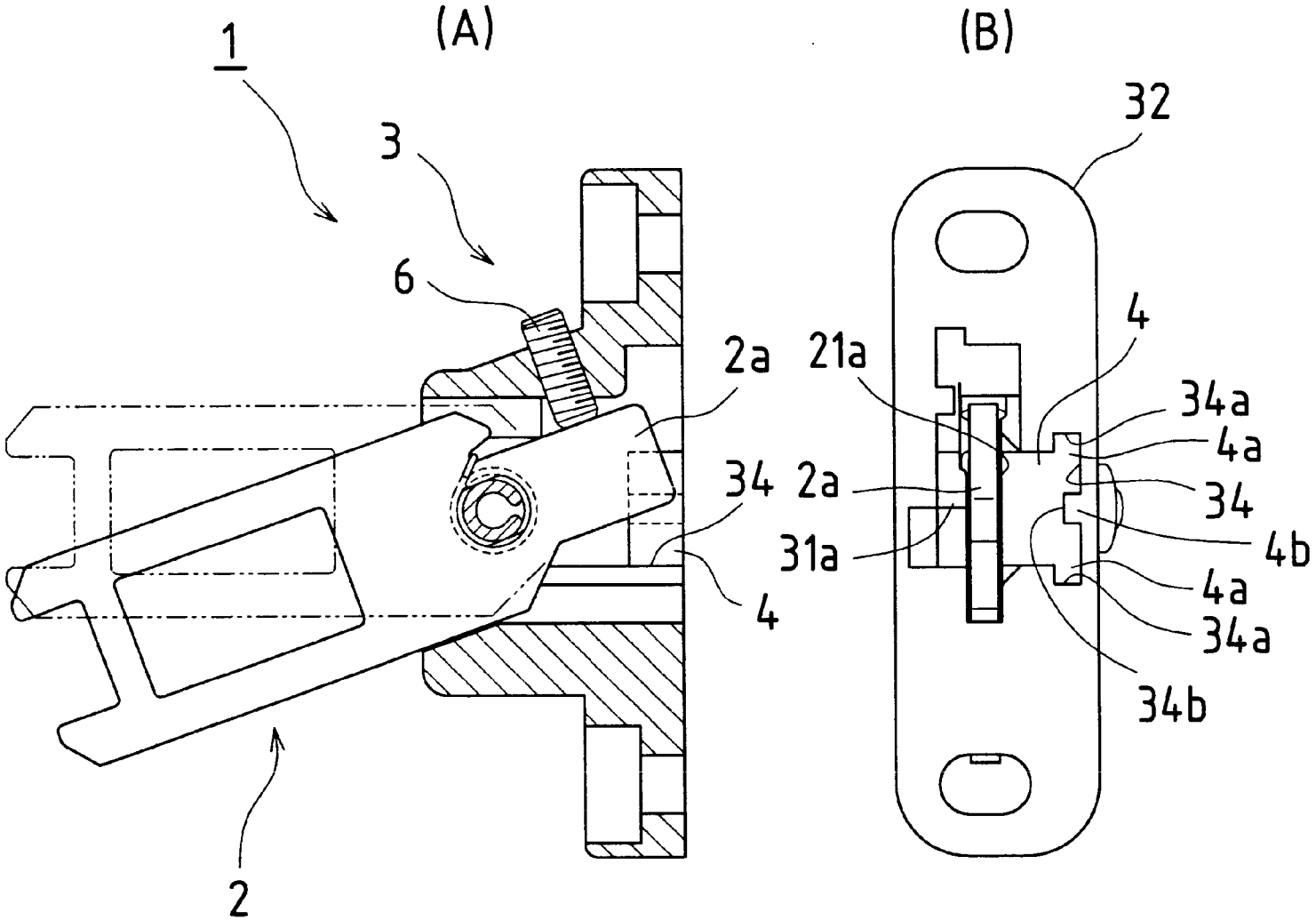
FIG. 9(A) is a vertical sectional view showing an example of the embodiment of FIG. 4 in use, and FIG. 9 (B) is a rear view thereof.

Specifically, as shown in FIG. 9, when the guide stopper 4 is fitted into the engagement space 34 which locates beside the first major surface of the contact piece 2*a* of the operation key 2, the guide stopper 4 touches the first major surface 21*a* of the contact piece 2*a*. In this situation, the guide stopper 4 and the support point 31*a* restrict the vertical movement of the operation key 2, allowing the operation key 2 to swing only in the horizontal direction. On the other hand, referring to FIG. 10, if the guide stopper 4 is fitted into the engagement space 35 which locates laterally of the contact piece 2*a*, the guide stopper 4 touches the lateral surface 22*a* of the contact piece 2*a*, and prevents the horizontal movement of the operation key 2. In this case, the operation key 2 is allowed to swing only in the vertical direction. Further referring to FIG. 11, since the helical torsion spring 5 constantly biases the contact piece 2*a* against the support point 31*a*, the operation key 2 swings about the support point 31*a* as fulcrum.

FIGS. 13 and 14 and the following description relate to the actions of the present embodiment.

FIG. 13 represents a posture for mounting the switch body 100 In this arrangement, the guide stopper 4 is fitted into the engagement space 34 (beside the first major surface of the contact piece 2*a*) of the actuator 1, as shown in FIG. 9, thereby effecting the horizontal swinging movement only. The actuator 1 is mounted on the revolving door 10 in the posture illustrated in FIG. 13. The swinging range of the operation key 2 should be adjusted in advance, such that the operation key 2 lies parallel to the insertion direction of the operation section 101 when the revolving door 10 turns and the front end portion of the operation key 2 starts to enter the key insertion hole 103 in the operation section 101.

According to the example of FIG. 13, while the revolving door 10 closes, the front end portion of the operation key 2 starts to enter the key insertion hole 103. Once the front end portion establishes contact with the guide surfaces 101*a*, the operation key 2 starts to swing (in the horizontal direction). In the meantime, the operation key 2 advances along the guide surfaces 101*a* deeply enough to cause rotation of the plate cam 111 in the operation section 101 (see FIG. 2(B)). Because of the horizontal swingability of the operation key 2, the contact of the front end portion of the operation key 2 with the switch body 100 generates nothing but an elastic force of the helical torsion spring 5, and never causes a strong force that may adversely affect the switch body 100.

Figure 10:
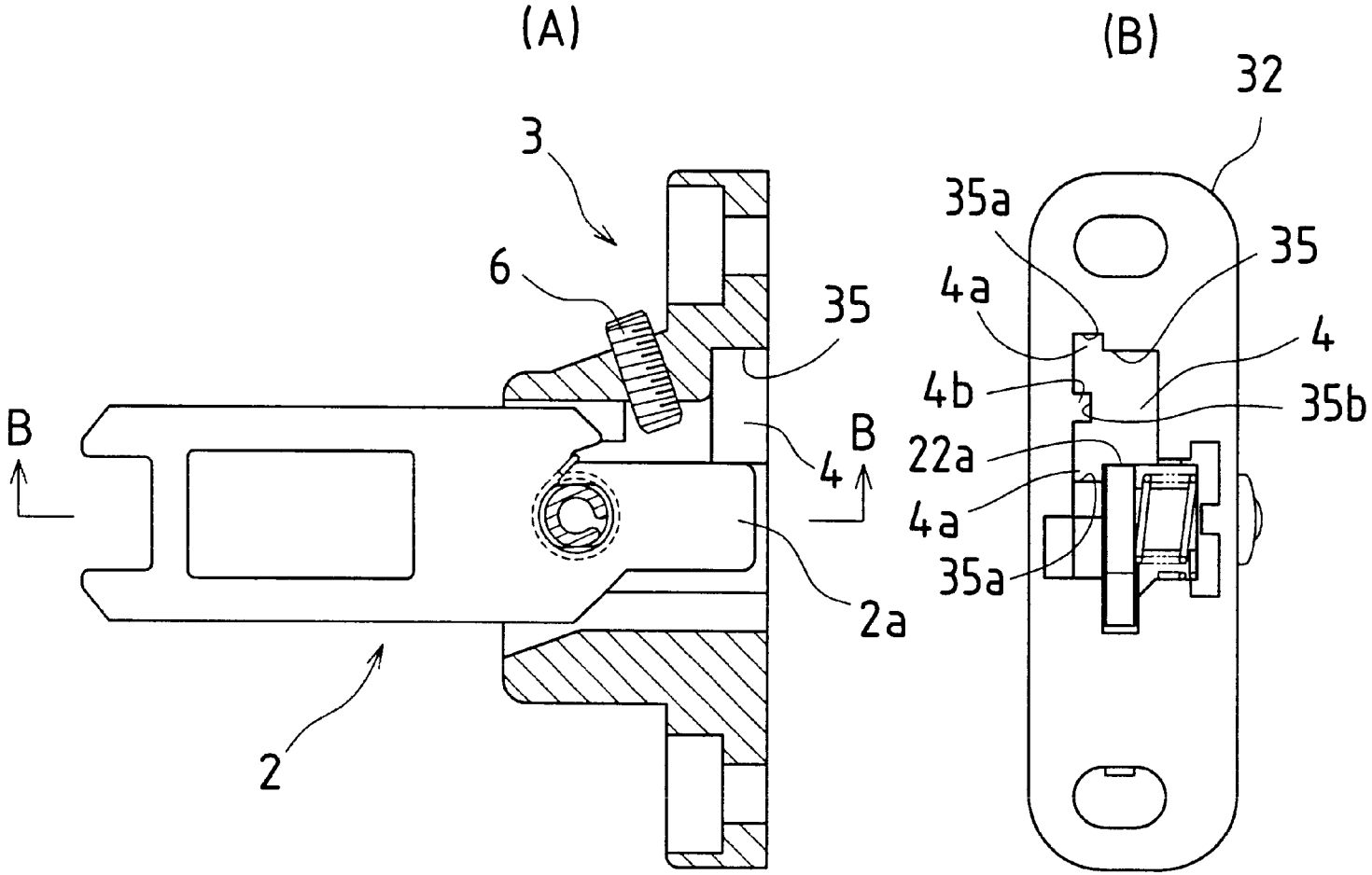
FIG. 10(A) is a vertical sectional view showing another example of the embodiment of FIG. 4 in use.
FIG. 10(B) is a rear view thereof.
Figure 11:
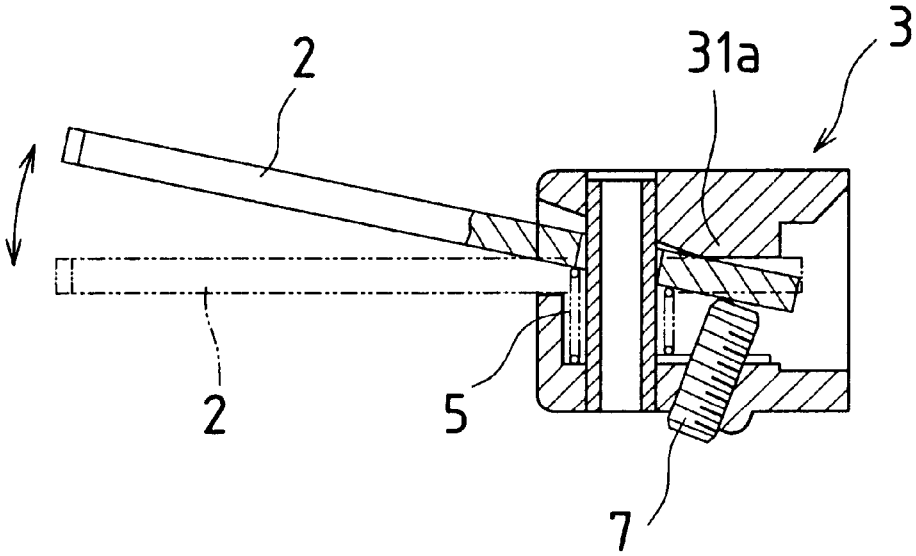
FIG. 11 is a sectional view of the example shown in FIG. 10, taken along the line B—B.

In contrast, FIG. 14 illustrates another posture for mounting the switch body 100. In this arrangement, the guide stopper 4 is fitted into the engagement space 35 (laterally of the contact piece 2*a*) of the actuator 1, as shown in FIG. 10, thereby effecting the vertical swinging movement only. The actuator 1 is mounted on the revolving door 10 in the posture illustrated in FIG. 14.

According to the example of FIG. 14, while the revolving door 10 closes, the front end portion of the operation key 2 starts to enter the key insertion hole 104. Once the front end portion establishes contact with the guide surface 101*b*, the operation key 2 starts to swing (in the vertical direction). In the meantime, the operation key 2 advances along the guide surface 101*b* deeply enough to cause rotation of the plate cam 111 in the operation section 101 (see FIG. 3(B)). Because of the vertical swingability of the operation key 2, the contact of the front end portion of the operation key 2 with the switch body 100 produces nothing but an elastic force of the helical torsion spring 5, and never causes a strong force that may adversely affect the switch body 100.

With regard to the embodiment illustrated in FIGS. 4 to 12, the swinging range of the operation key 2 can be adjusted by operating the adjustment screws 6, 7 provided in the base 3. Hence, it is possible to set a swinging range in a simple manner, depending on the conditions of using the safety switch, that is, the revolution radius of the revolving door 10. The mechanisms for adjusting the swinging range include many variations, in addition to the adjustment screws 6, 7. Some examples are given in FIGS. 15 and 16 below.

Figure 15:
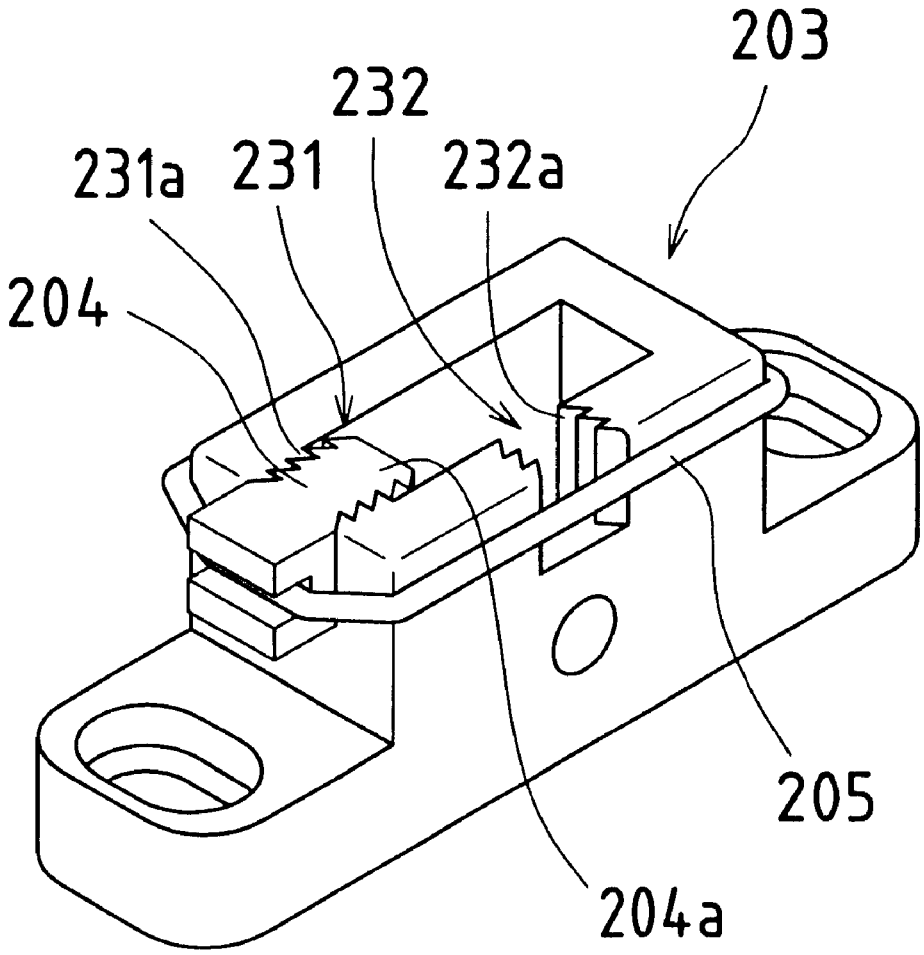
FIG. 15 is a perspective view showing an example of the mechanism for adjusting the swinging range of the operation key.

In the adjustment mechanism illustrated in FIG. 15, a base 203 includes two recesses 231, 232 having internally serrated steps 231*a*, 232*a*. Also provided is an adjustment block (stopper) 204 formed with serrated steps 204*a* which can fit with each of the recesses 231, 232. With this structure, the swinging range of the operation key is adjustable step by step, by altering the manner of fitting the adjustment blocks 204 into the recesses 231, 232, namely, the manner of engaging the serrated steps 204*a* of the adjustment blocks 204 with the serrated steps 231*a*, 232*a* of the recesses 231, 232. Additionally, in the adjustment mechanism of FIG. 15, a band 205 is wound around the sides of the base 203 to prevent disengagement of the adjustment block 204.

Figure 16:
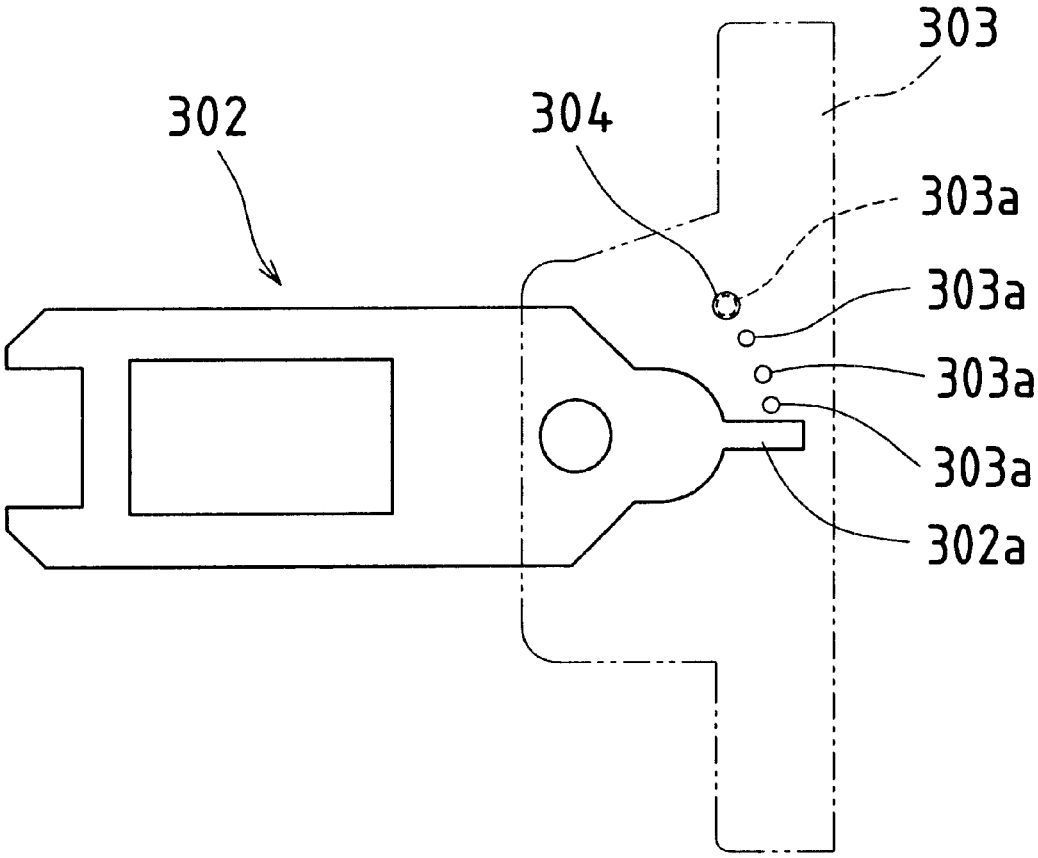
FIG. 16 is a plan view showing another example of the mechanism for adjusting the swinging range of the operation key.

In the adjustment mechanism illustrated in FIG. 16, the rear end of an operation key 302 is integrated with an engaging piece 302*a*. A base 303 includes pin holes 303*a* . . . 303*a* which are provided at a predetermined pitch along the circumference centered on the swinging center of the operation key 302. Based on a proper choice, an engaging pin 304 is inserted into any one of these pin holes 303*a* . . . 303*a*, so that the swinging range of the operation key 302 can be adjusted step by step. Incidentally, in order to bias the operation key 2 horizontally and vertically, the above embodiments utilize the torsion force and compression force of the single helical torsion spring 5. Instead, the operation key 2 may be independently biased in the horizontal direction and the vertical direction with separate elastic members.

Figure 12:
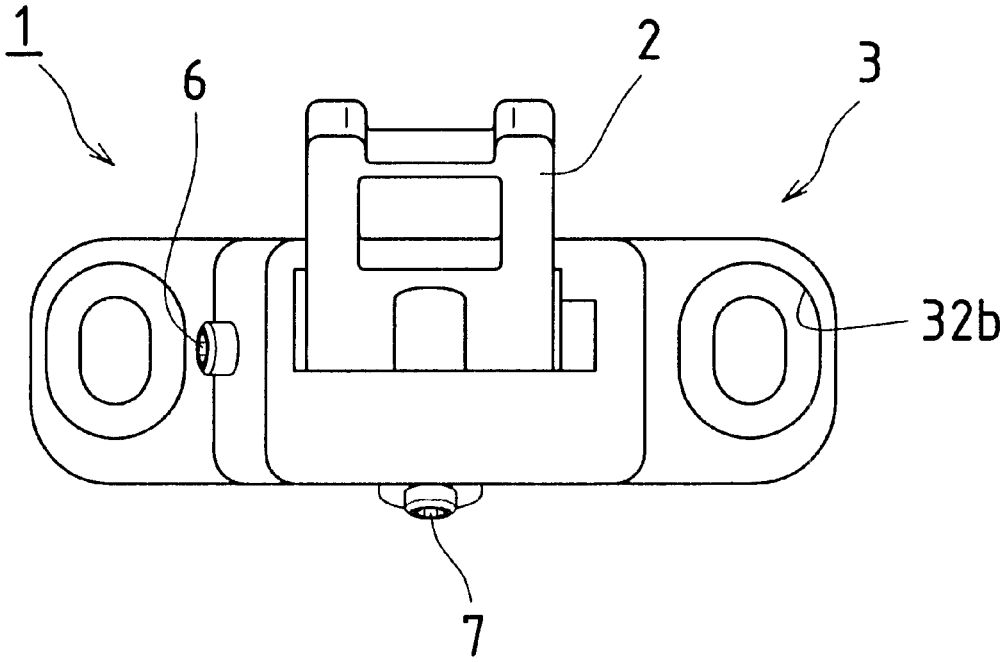
FIG. 12 is a front view of the example shown in FIG. 10.

In the above embodiments, an elliptic counterbore 32*b* is machined around the mounting slot 32*a* in the mounting part 32 of the base 3 (see FIG. 12). Alternatively, a hexagonal counterbore may be machined around the mounting slot 32*a*, into which a hexagonal nut is fitted and screwed. According to this arrangement, the actuator can be mounted on the revolving door, as screwed from the backside of the actuator-mounting surface of the revolving door.

Figure 17:
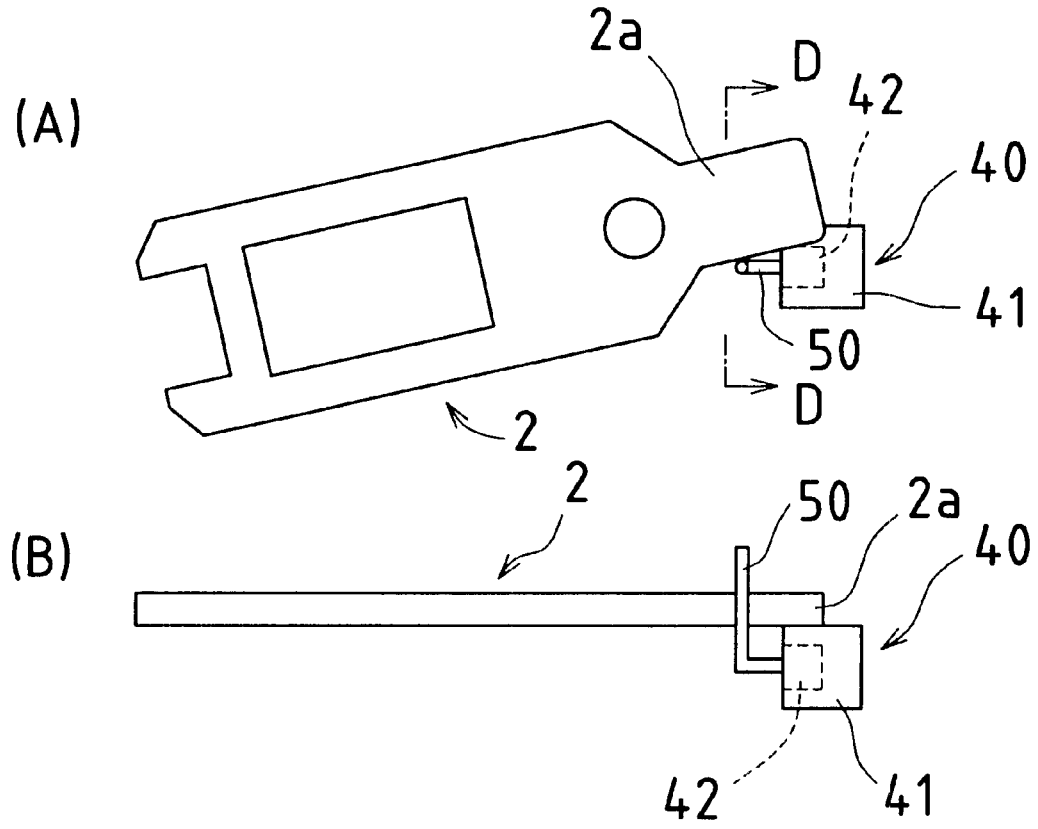
FIG. 17(A) is a plan view schematically showing the structure of another embodiment of the present invention.
FIG. 17(B) is a side view thereof.
Figure 18:
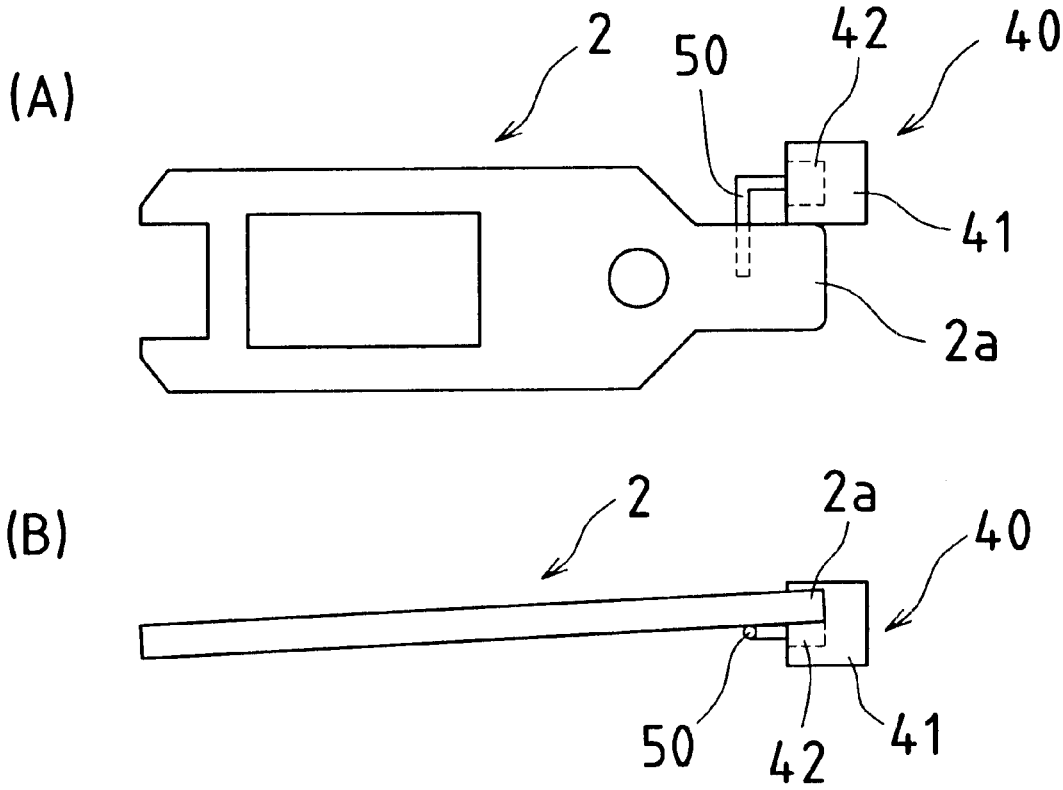
FIG. 18(A) is a plan view schematically showing the structure of the another embodiment of the present invention.
FIG. 18(B) is a side view thereof.

FIGS. 17 and 18 represent another embodiment of the present invention.

Figure 19:
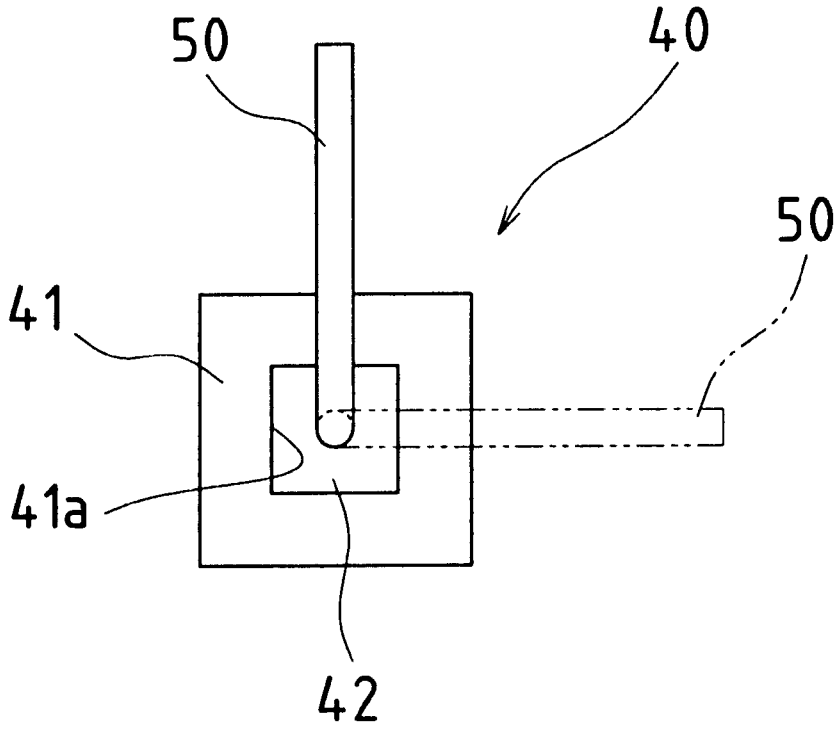
FIG. 19 is a view taken in the direction of arrows D—D in FIG. 17.

This embodiment is characterized in that a guide stopper 40 is equipped with a spring piece 50 for biasing the operation key 2. The spring piece 50 is bent in the form of the letter L, and one end thereof is fixed on a support block 42. As illustrated in FIG. 19, the support block 42 is a rectangular solid which appears a square from a front view. The support block 42 is fitted in a square-sectioned recess 41*a* formed in a guide stopper body 41. By varying this fitting orientation, the orientation of the spring piece 50 can be altered by 90 degrees relative to the guide stopper body 41.

According to this embodiment, as shown in FIGS. 17(A) and (B), the guide stopper 40 is disposed in contact with the first major surface of the contact piece 2*a* of the operation key 2, with the spring piece 50 touching the lateral surface of the contact piece 2*a*. In this state, the operation key 2 can swing only in the horizontal direction, and receives a horizontal bias force generated by the spring piece 50. On the other hand, in FIGS. 18(A) and (B), the orientation of the spring piece 50 is turned 90 degrees relative to the guide stopper body 41. In this case, the guide stopper 40 lies in contact with the lateral surface of the contact piece 2*a* of the operation key 2, with the spring piece 50 touching the first major surface of the contact piece 2*a*. Now, the operation key 2 is allowed to swing only in the vertical direction, and receives a vertical bias force generated by the spring piece 50.

Figure 20:
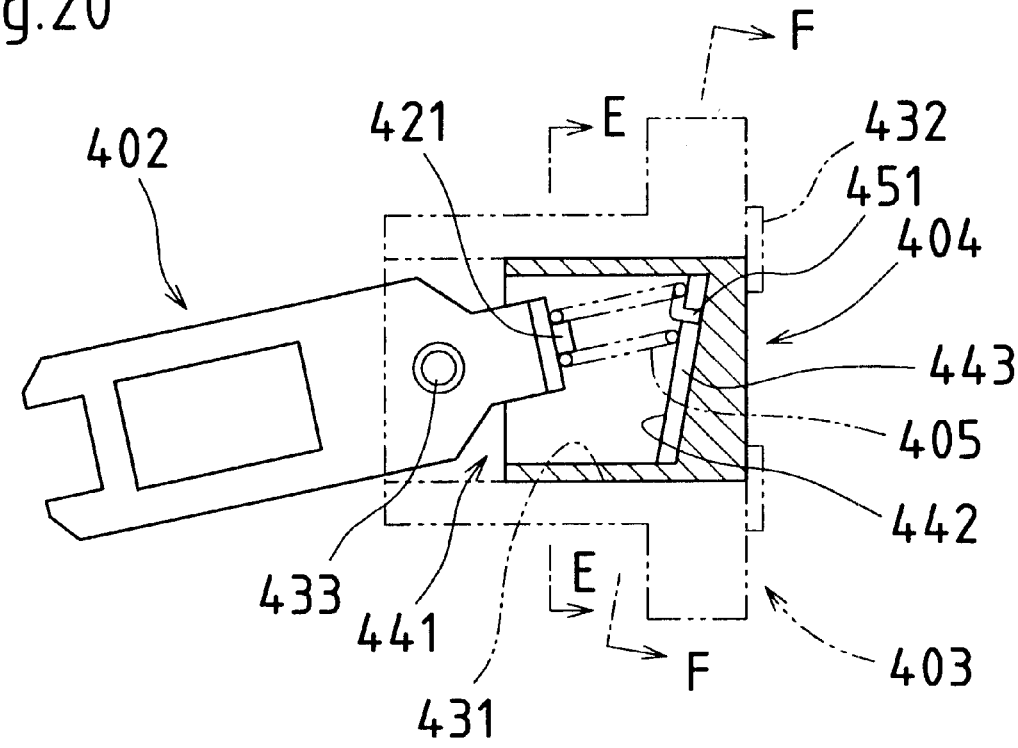
FIGS. 20 and 21 are sectional views schematically showing the structure of yet another embodiment of the present invention.
Figure 21:
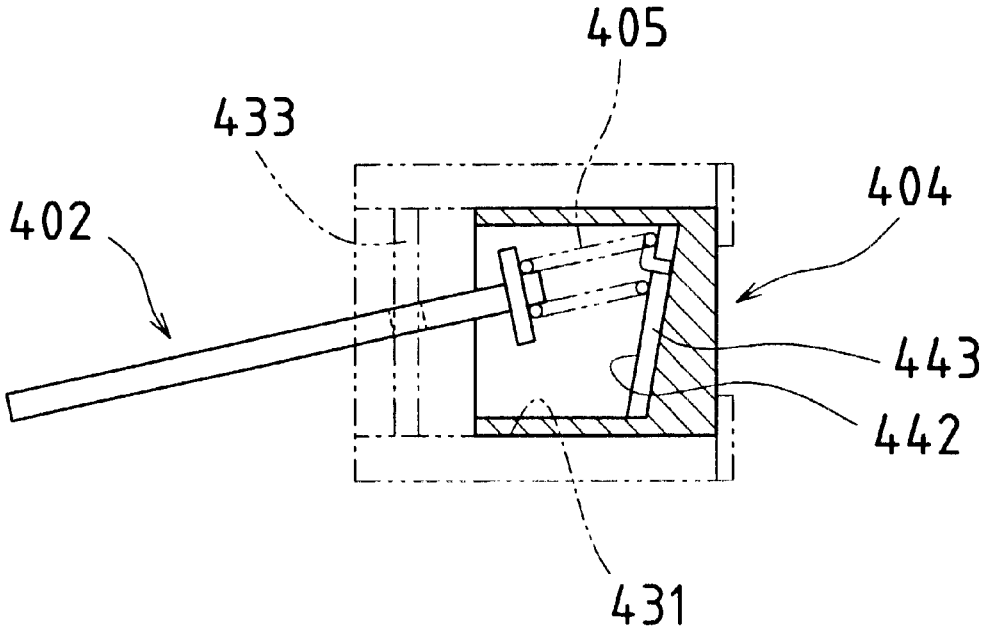
Figure 22:
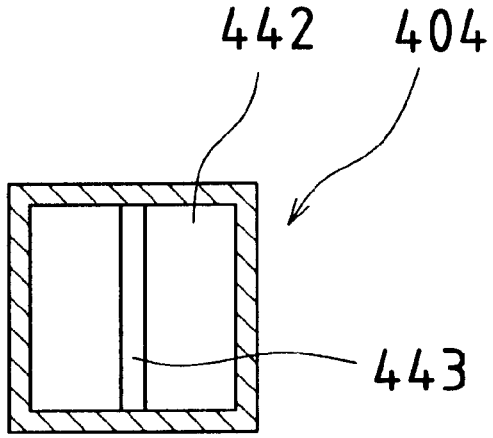
FIG. 22 is a sectional view taken along the line E—E in FIG. 20.
Figure 23:
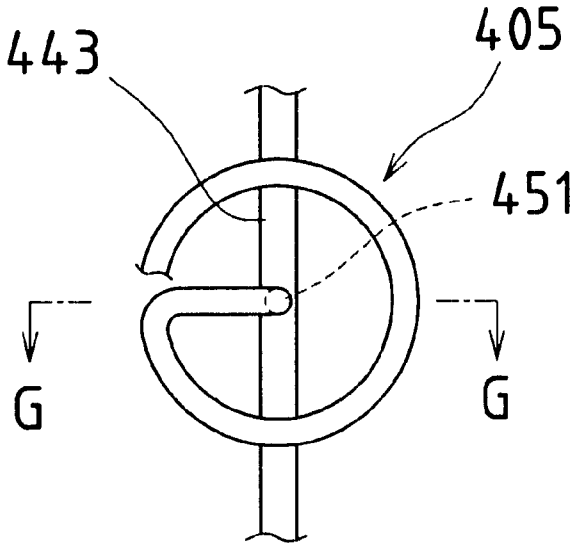
FIG. 23 is a view taken in the direction of arrows F—F in FIG. 20.
Figure 24:
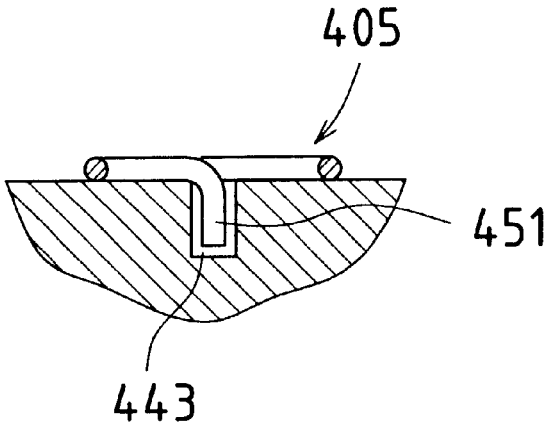
FIG. 24 is a sectional view taken along the line G—G in FIG. 23.

FIGS. 20 and 21 are schematic sectional views showing the structure of yet another embodiment of the present invention. FIG. 22 is a sectional view taken along the line E—E in FIG. 20. FIG. 23 is a view taken in the direction of arrows F—F in FIG. 20. FIG. 24 is a sectional view taken along the line G—G in FIG. 23.

This embodiment is characterized by a change-over box 404 which is the means for selectively changing the swinging direction of an operation key 402.

The change-over box 404 is a rectangular box (with a square front) which opens only at its front side (an opening 441). The opposite side is defined by an inclined surface 442, in the center of which a slit-shaped guide groove 443 extends in the inclination direction. The change-over box 404 can be fitted from the back of the base 403, into a square-sectioned engagement space 431 in the base 403. In order to secure the change-over box 404, pressure plates 432 are provided on the rear surface of the base 403.

The operation key 402 is held in the base 403 by means of a support shaft 433. The rear portion of the operation key 402 is equipped with a spring washer 421, at which one end of a coil compression spring 405 is anchored. The extreme end of the coil compression spring 405 is turned to the center of the spring, where the extreme end is bent outwardly.

Referring to FIG. 20 for the assembly in this embodiment, the change-over box 404 is fitted into the engagement space 431 in the base 403, with the extreme end 451 of the coil compression spring 405 being aligned with the guide groove 443. In the state of FIG. 20, the operation key 402 is held as inclined downwards (based on the figure), due to the action of the elastic force of the coil compression spring 405 and the inclined surface 442. In this state, an upward force (based on the figure) which acts on the front end portion of the operation key 402 causes swinging movement (horizontal) of the operation key 402. When the acting force ceases to exist, the operation key 402 returns to the initial state.

According to this embodiment, the change-over box 404 can be removed from the base 403. The removed change-over box 404 is turned 90 degrees relative to the base 403, and re-inserted into the engagement space 431 in the base 403 in the same manner as above. This alternative mode is illustrated in FIG. 21, in which the operation key 402 is allowed to swing only in the vertical direction. Depending on the swinging direction of the operation key 402, the change-over box 404 can be positioned in four different orientations.

Figure 25:
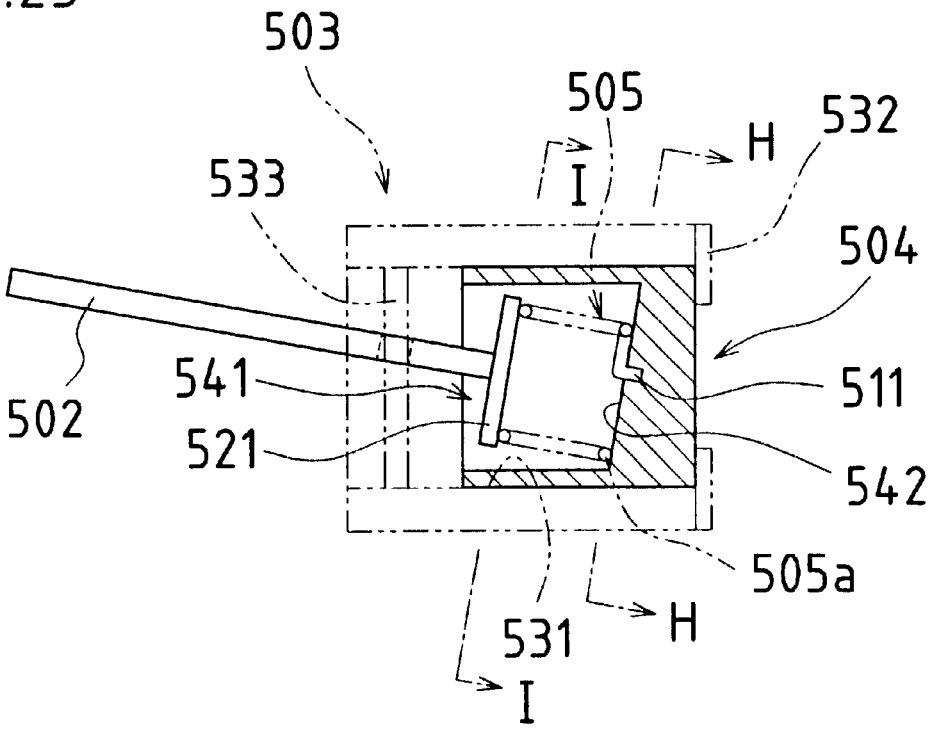
FIGS. 25 and 26 are sectional views schematically showing the structure of still another embodiment of the present invention.
Figure 26:
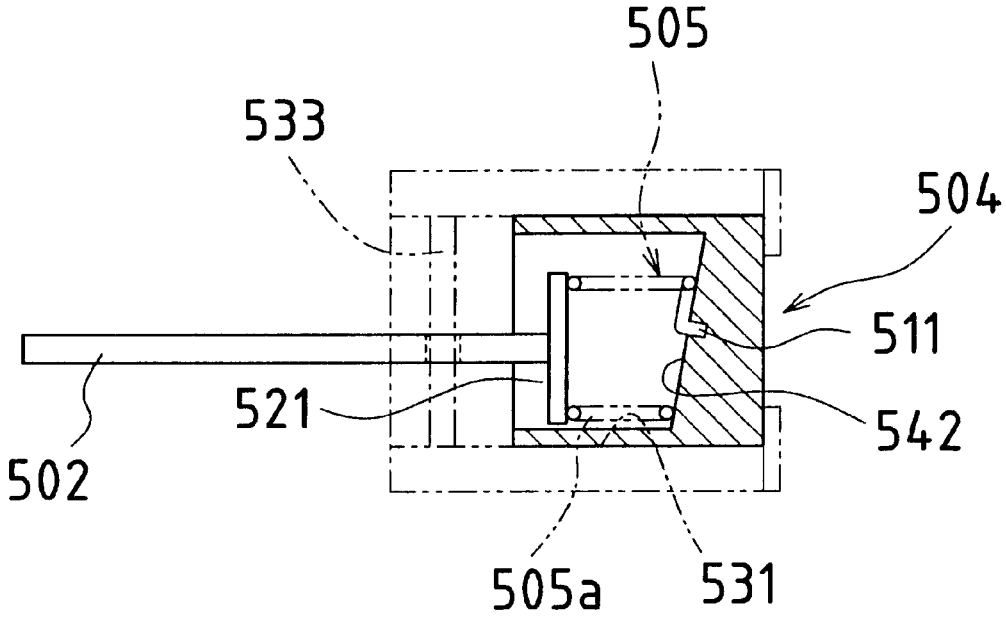
Figure 27:
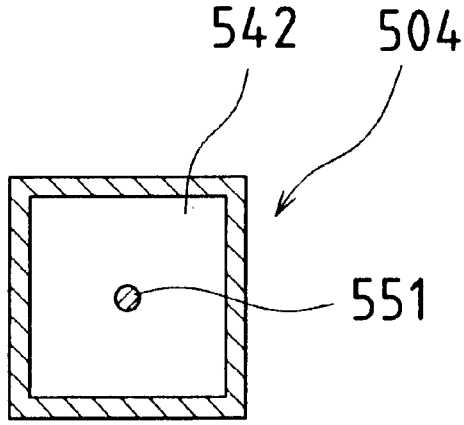
FIG. 27 is a sectional view taken along the line H—H in FIG. 25.
Figure 28:
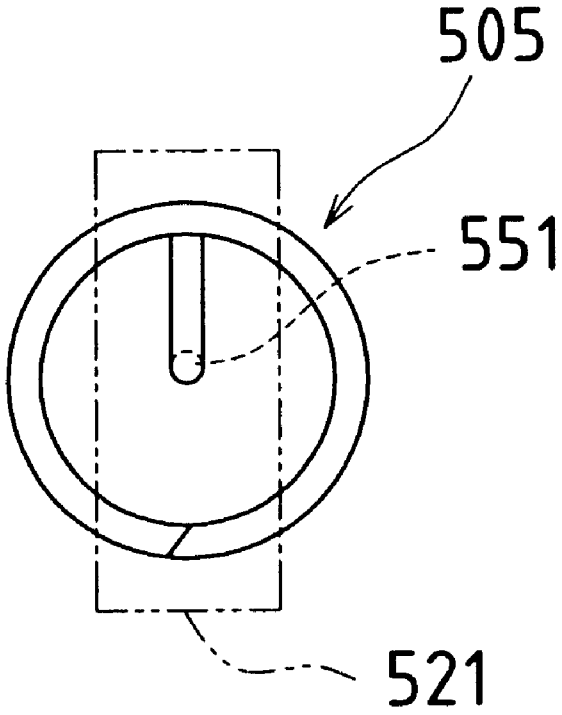
FIG. 28 is a view taken in the direction of arrows I—I in FIG. 25.
Figure 29:
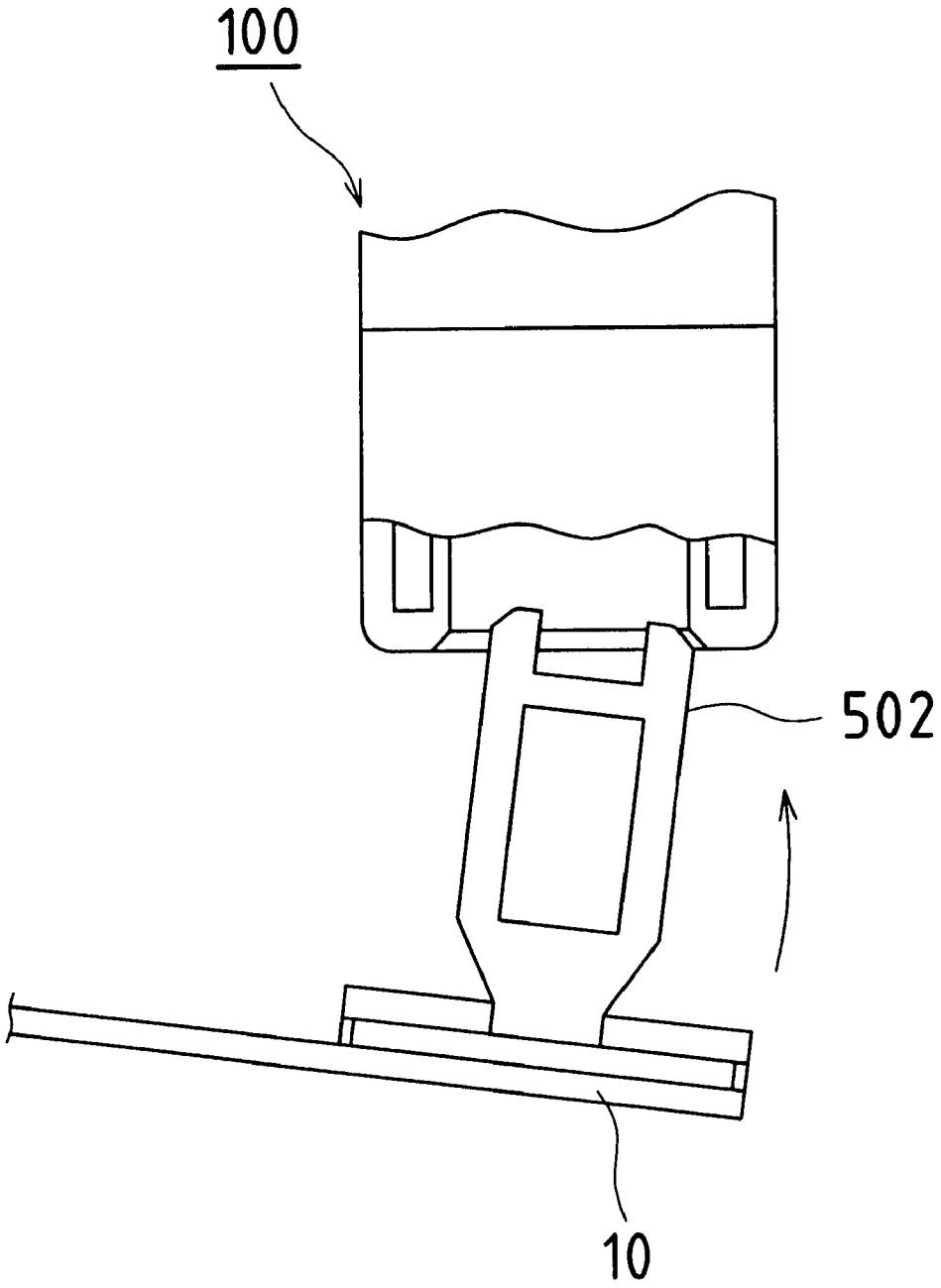
FIG. 29 describes a problem concerning conventional actuators.

FIGS. 25 and 26 are sectional views schematically showing the structure of still another embodiment of the present invention. FIG. 27 is a sectional view taken along the line H—H in FIG. 25. FIG. 28 is a view taken in the direction of arrows I—I in FIG. 25.

This embodiment is characterized by a change-over box 504 which is the means for selectively changing the swinging direction of an operation key 502.

The change-over box 504 is a rectangular box (with a square front) which opens only at its front side (an opening 541). The change-over box 504 can be fitted from the back of the base 503, into a square-sectioned engagement space 531 in the base 503. In order to secure the change-over box 504, pressure plates 532 are provided on the rear surface of the base 503.

Similar to the above embodiment, the base 503 contains a support shaft 533, and the operation key 502 is held on the support shaft 533. The rear portion of the operation key 502 is equipped with a spring seat 521. A coil spring 505 is placed between the spring seat 521 and the inclined surface 542 of the change-over box 504. The extreme end 511 of the coil spring 505 is secured on the change-over box 504.

Referring to FIG. 25 for the assembly in this embodiment, the change-over box 504 is fitted into the engagement space 531 in the base 503, with the change-over box 504 accommodating the coil spring 505. In the state of FIG. 25 (the free state) where the spring seat 521 of the operation key 502 is subjected to the force of the coil spring 505, the spring seat 521 stands parallel to the inclined surface 542 to keep the operation key 502 inclined. In this state, the operation key 502 can be inserted into the insertion hole 103 (104), so that a downward force (based on the figure) is imposed on the front end portion of the operation key 502. Under this force, the coil spring 505 is compressed at a part 505*a* located along one corner (the bottom corner in the figure) of the inclined surface 542, orienting the operation key 502 in a parallel (horizontal) posture (FIG. 26). Afterwards, when the operation key 502 is pulled out of the insertion hole 103 (104), the initial state (FIG. 25) is recovered by the recovery force of the compressed part 505*a* of the coil spring 505.

Similar to the foregoing embodiment, this embodiment allows the change-over box 504 to be removed from the base 503. The removed change-over box 504 is turned 90 degrees relative to the base 503, and reinserted into the engagement space 531 in the base 503 as described above. This arrangement enables the operation key 502 to alter its swinging directions (by 90 degrees). Depending on the swinging direction of the operation key 502, the change-over box 504 can be positioned in four different orientations.

According to the present invention, the actuator for a safety switch gives freedom to the operation key. Therefore, the actuator can be effectively utilized not only for a revolving door with a small revolution radius but also for a connection point with a mobile device or for a sliding door, where the positional relationship between the switch body and the actuator requires some allowance.

Industrial Applicability

As described above, the actuator for a safety switch according to the present invention can be used for a revolving door with a small revolution radius, to give an example. It is also applicable to a sliding door, even when the switch body and the mounting surface of the actuator may not match. As a result, the actuator can be used in a wider range of application, and, further, in various manners according to user's individual objects.

What is claimed is:

1. An actuator for a safety switch which comprises an operation key to be inserted into a key insertion hole formed in the safety switch, and a base, characterized by means for holding the operation key on the base, which means permits free swinging movement of the operation key in two orthogonal directions, and the base being characterized in that it includes means for selectively restricting the swinging movement of the operation key to either of the two orthogonal directions.

2. An actuator for a safety switch as claimed in claim 1, characterized in that the base contains two engagement spaces formed therein and a guide stopper operative to be selectively fitted into either of the engagement spaces for restricting, through use of the guide stopper, the swinging movement of the operation key to one direction.

3. An actuator for a safety switch as claimed in claim 1 or 2, characterized by an adjustment mechanism operative with the operation key for independently adjusting a swinging range of the operation key in each of the orthogonal directions.

4. An actuator for a safety switch as claimed in claim 1 or claim 2, including an elastic member bearing between the operation key and the base for biasing the operation key in each of the orthogonal directions.

5. An actuator for a safety switch as claimed in claim 4, characterized in that the elastic member is a helical coil spring which is operative to bias the operation key in each of the orthogonal directions by a torsion force and a compression force both generated by the helical coil spring.

* * * * *